US006355912B2

(12) United States Patent
Allard

(10) Patent No.: US 6,355,912 B2
(45) **Date of Patent: *Mar. 12, 2002**

(54) SAFETY CIRCUIT FOR HEATING DEVICES USING PTC WIRE

(75) Inventor: John Allard, Hattiesburg, MS (US)

(73) Assignee: Sunbeam Products, Inc., Boca Raton, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/482,816

(22) Filed: Jan. 13, 2000

(51) Int. Cl.[7] ..... H05B 1/02

(52) U.S. Cl. ..... 219/481; 219/497; 219/508; 219/505; 219/212

(58) Field of Search ..... 219/216, 481, 219/494, 497, 501, 505, 508, 509, 212; 307/117, 119

(56) References Cited

U.S. PATENT DOCUMENTS

| | | | | | |
|---|---|---|---|---|---|
| 4,251,717 | A | * | 2/1981 | Cole | 219/497 |
| 5,229,579 | A | * | 7/1993 | Ingraham et al. | 219/505 |
| 5,726,850 | A | * | 3/1998 | Rowe, Jr. | 361/100 |
| 5,746,053 | A | * | 5/1998 | Hibino | 60/277 |

* cited by examiner

*Primary Examiner*—Mark Paschall
(74) *Attorney, Agent, or Firm*—Kramer Levin Naftalis & Frankel LLP

(57) ABSTRACT

A heating appliance such as an electric heating blanket having a control circuit which controls the application of power to the heating element of the blanket based on the condition of the heating element. The circuit senses the voltage at the end of the heating element in order to determine if the heating element has a short or an open circuit condition therein. Under normal conditions, the sensed voltage will be above a predetermined threshold value. If the sensed voltage falls below the threshold value, the control circuit shuts off power to the heating element. The control circuit will keep power off until the fault condition has been corrected and power has been removed and reapplied to the control circuit.

5 Claims, 4 Drawing Sheets

SAFETY CIRCUIT FOR HEATING DEVICES USING PTC WIRE

FIELD OF THE INVENTION

The present invention relates to heating devices, particularly circuits for controlling heating devices.

BACKGROUND INFORMATION

The use of positive thermal coefficient (PTC) elements in electric heating pads and blankets is well known. Typically, a PTC element comprises an electrically conductive PTC plastic material arranged between two conductors. If, however, one of the conductors in intimate contact with the PTC material breaks, arcing may occur. Since the heating wire used in heating pads and electric blankets is typically made very thin and flexible and is subjected to repeated flexing from use, conductor breaks in the heating wire are common. When a conductor break occurs, a line voltage can develop across the break causing an arc to jump across the break. Such an arc can raise the temperature of the PTC material to auto ignition, which can start a fire. If allowed to continue for an extended period of time (e.g., approximately 250 ms or more) such arcing will likely ignite a fire.

A safety circuit for preventing this condition from continuing and possibly causing a fire is described in U.S. Pat. No. 4,436,986 to Carlson. When the Carlson circuit detects a conductor break in the heating element, it generates a current surge that blows an input power fuse, thereby disabling the application of power to the heater. The fuse, however, must be sized to handle currents of two or three times the continuous current rating of the heater in order to accommodate the current inrush associated with the start-up characteristics of the PTC material. The Carlson circuit also relies on the fuse to deactivate the appliance in all possibilities of short circuits.

Typically, an adjustable bimetallic control switch is used to provide differing heat settings for PTC-based heating appliances. As current flows through the bimetallic element, the element heats up and bends due to the differential expansion of the metals incorporated in the element. The deflection causes the contacts to open and interrupt the current to the heater and the bimetallic element to cease bending. The bimetallic element then cools down until contact is again made and the cycle repeats. The deactivation of this type of electromechanical control is typically accomplished by blowing a fuse that is in series with the switch.

Modern electrical power controls use solid state switching devices such as silicon control rectifiers (SCR), power transistors, solid state relays and triacs. U.S. Pat. No. 4,315,141 to Mills describes a temperature overload circuit having a pair of solid state switches biased by a temperature sensitive capacitive element. In such control systems, a small signal controls the switching of larger load currents.

Logic integrated circuits or microprocessors can be used to control high-speed solid state power switching devices. Such processors are typically capable of operating at speeds many times the 50 or 60 Hz frequency of typical AC power sources. This capability makes it possible to control each AC cycle and perform switching as the AC power waveform crosses zero thereby lowering the noise generation associated with AC switching and improving efficiency. Microprocessors and logic ICs, however require programming, thereby adding a significant level of complexity, customization and thus cost.

U.S. Pat. No. 5,420,397 to Weiss et al. describes a microcontroller-based detection circuit for limiting arcing time by either disabling the microcontroller or switching off the power. An interruption in either the hot or neutral AC power conductors will signal the microcontroller and, after a short time period, the microcontroller enters a safety mode condition in which power to the PTC heater is turned off. In order to prevent repetitive arcing by continuously restarting the microcontroller, the safety mode is reset only by removing power and waiting a predetermined time interval. Repeated and prolonged arcing will cause the arc zone to heat up, such that the arc causes the PTC material to break down, creating a carbon conduction path contributing to the volatility of the fault.

Typically, electric blankets and heating pads can be disconnected from their control circuits to allow the electric blanket or heating pad to be washed. For safety purposes, if the control circuit is turned on before the heating element is connected or if the heating element is disconnected while power is applied, the control circuit should go into a safety mode and deactivate the application of power.

A problem with known control circuits is that a fault cannot be detected before full power is applied. This can be very dangerous, since as soon as full power is provided, arcing may occur, which could result in electrocution and/or fire. It is therefore desirable to provide the unit with some means for detecting a fault before full power is applied.

SUMMARY OF THE INVENTION

The present invention provides a circuit for protecting users against failures of PTC wire heating elements in electrical heating appliances. In an exemplary embodiment, a sub-circuit located in the heating device (e.g., blanket, pad) senses the voltage at the end of the PTC wire and provides a heating element status signal to a control circuit. The control circuit mixes the status signal with a sample of the power supplied to the PTC wire to provide a signal representative of the condition of the PTC wire. The circuit of the present invention preferably detects when the temperature control cycles power to the PTC wire to prevent false tripping. If the signal indicates the presence of a fault, power is removed from the PTC heating wire. Power is kept off until the circuit is reset.

In a further exemplary embodiment, the sensing circuit uses phase in-coding to allow more than one sense circuit to use the same signal line, thereby reducing the number of conductors between the heating device and the control circuit. The heating device thus can be coupled to the circuit with a small number of conductors (e.g., 3 wires for a single heating element and 4 wires for two heating elements).

In an exemplary embodiment, the circuit of the present invention can be reset by removing power from the circuit (e.g., unplugging the appliance from a wall outlet). If power is reapplied while the fault is still present, the circuit will not reset.

The circuit of the present invention monitors each cycle of the AC power applied to the heating elements, thereby providing a fast response time for detecting intermittent failures before they develop into dangerous conditions.

Moreover, the common failure mode of the circuit components will cause a trip condition, thus deactivating the heater. Improper coupling of the heater to the circuit will also preferably cause the circuit to trip.

The circuit of the present invention can be implemented with a low parts count, using conventional components, thereby providing high reliability and low-cost.

DETAILED DESCRIPTION

Figure 1:
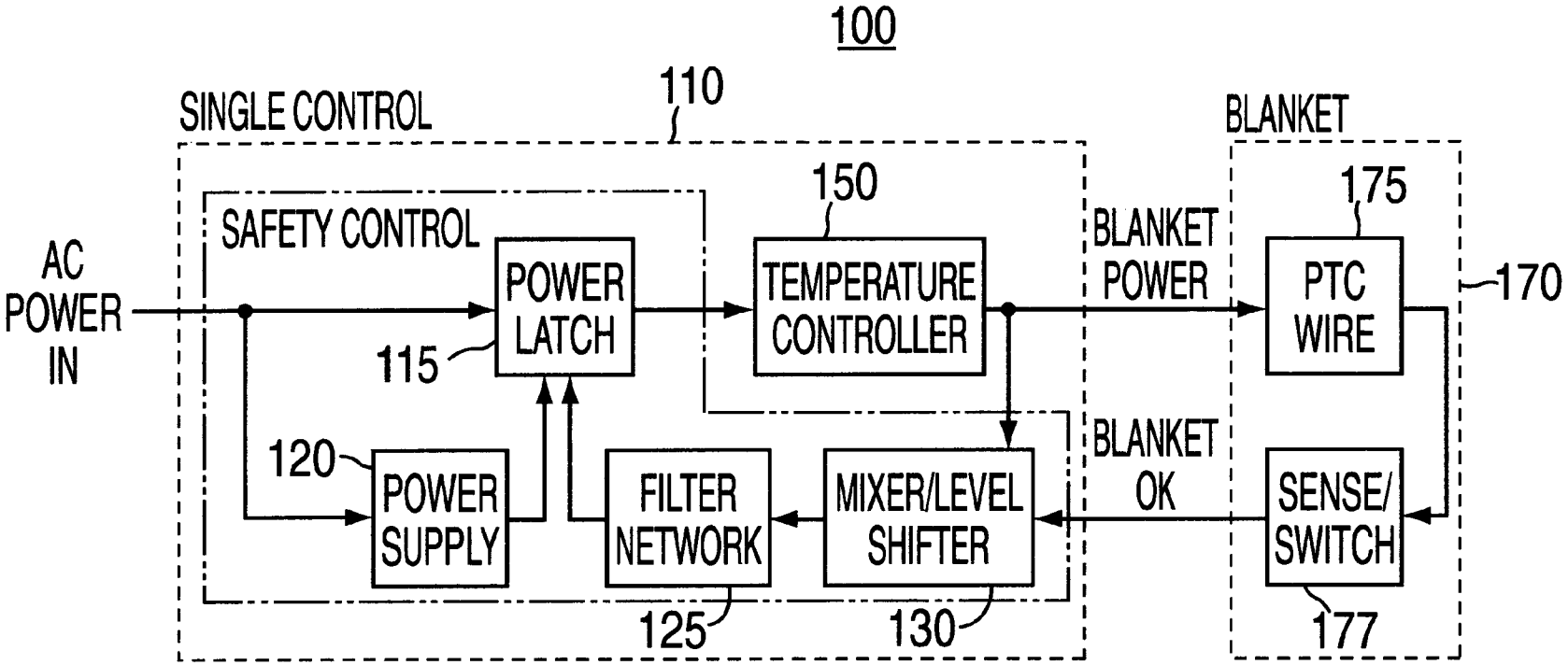
FIG. 1 is a block diagram of a first exemplary embodiment of a circuit in accordance with the present invention.

FIG. 1 is a block diagram of an exemplary heating appliance 100 in accordance with the present invention. The appliance 100 comprises a circuit 110 and a heating blanket module 170. The module 170 comprises a heating wire element 175 comprising, for example, PTC wire, or the like. Power, such as 120 VAC is applied to the circuit 110, which controls the application of power to the heating blanket module 170. While the exemplary embodiment described comprises a heating blanket, the present invention is applicable to a wide variety of heating appliances.

Generally, the circuit 110 can sense both breaks and shorts of the heating wire element 175 by sensing the voltage at the end of the heating wire element and adding in a sampling of the power applied to the heating wire element, if the sensed voltage is above a predetermined threshold, then the circuit 110 maintains power to the blanket wire 175. If the sensed voltage is less than a predetermined trip voltage, the circuit 110 disconnects power from the heating wire 175. Either a break or a short in the heating wire 175 will cause the voltage at the end of the wire to go to below the trip point. Preferably, after such a loss of voltage the control circuit 110 can only be reset if power is removed from the circuit and reapplied (e.g., power is removed by disconnecting the AC line cord).

The safety circuit 110 contains a power latch block 115, a power supply block 120, a filter network block 125, a mixer/level shifter block 130 and a temperature controller 150.

The heating blanket module 170 comprises a single heating element 175. A dual heating element embodiment is described below in connection with FIGS. 3 and 4. The heating blanket module 170 comprises a voltage sensing sub-circuit 177 that generates a BLANKET OK signal that is provided to the control circuit 110. The BLANKET OK signal indicates the condition of the heating element 175 as determined from the voltage that is sensed at the end of the heating element 175.

The temperature controller 150 is arranged between the power control circuitry 110 and the heating element 175 and serves to control the application of power to the heating element in accordance with the temperature of the heating element and a desired temperature set by the user. The temperature controller 150 may be any suitable duty cycle regulating device (e.g., solid state or mechanical) as is familiar in the art.

Figure 2:
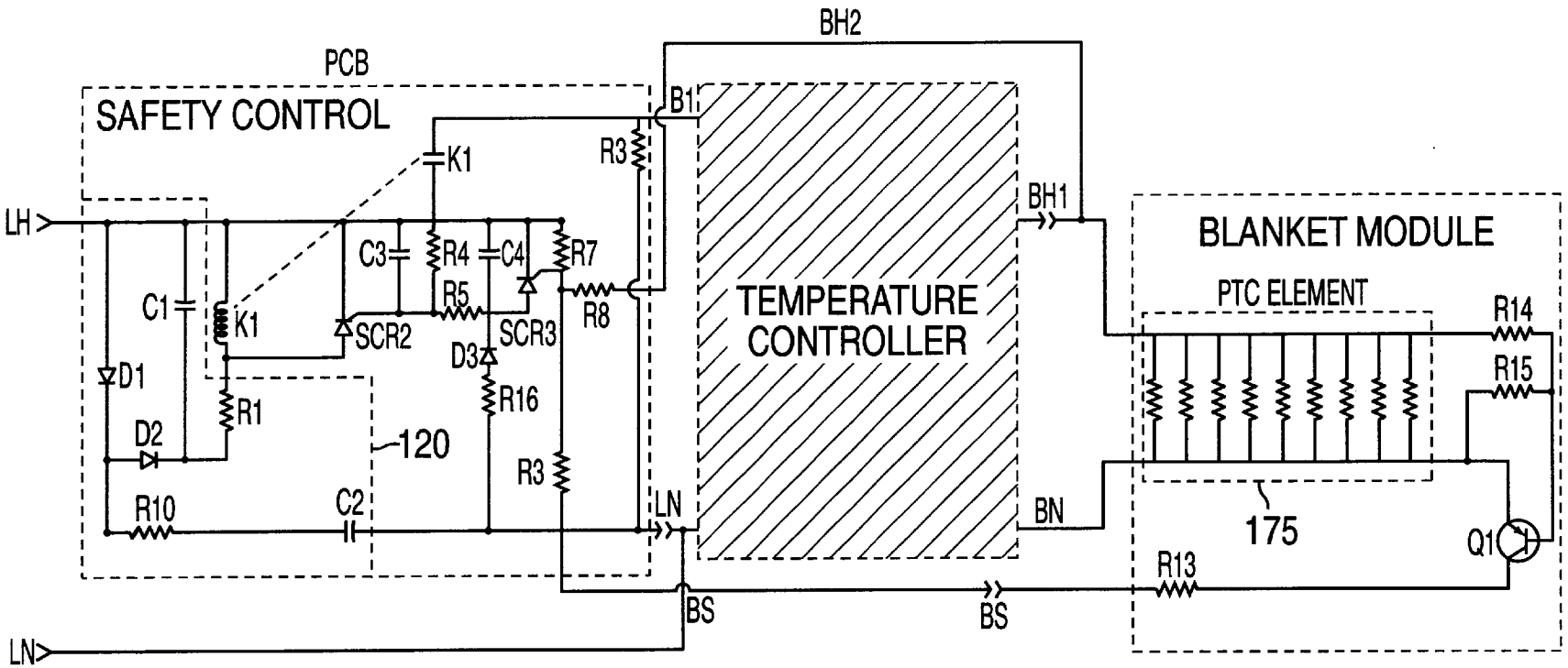
FIG. 2 is a schematic diagram of the exemplary circuit of FIG. 1.

FIG. 2 shows a schematic diagram of an exemplary embodiment of a circuit in accordance with the present invention. AC line power (e.g., 120 volts AC) is applied across LN and LH (i.e., LH is the "hot" side of the line and LN is the "neutral" side.) The power supply block 120 comprises capacitors C1 and C2, resistors R1 and R10 and diodes D1 and D2, arranged as shown in FIG. 2. This sub-circuit reduces, rectifies and filters the AC line voltage applied to the circuit at LN and LH.

The output of the power supply sub-circuit 120 is coupled to the coil of a relay K1. The relay K1 comprises normally open contacts arranged in series with a conductor that provides power to the heating element 175 of the blanket module 170, via the temperature controller 150. When the contacts of the relay K1 are closed, power is applied to the heating element 175 via the temperature controller 150. The normally open contacts of the relay K1 close when the relay's coil is energized. Under normal operation, when AC line power is applied across LH and LN, the relay K1 is activated to supply power to the heating element 175 of the blanket module.

A silicon controlled rectifier (SCR) SCR2 is coupled across the coil of relay K1. When SCR2 is triggered on (as described below), it shorts the coil of relay K1. With SCR2 on, the current through the relay coil is diverted through SCR2, the coil is deactivated and the normally open contacts of the relay K1 are opened, thereby removing power from the heating element 175. The resistor R1 is coupled in series with the relay coil in order to limit the current through SCR2 when the relay coil is shorted out by SCR2.

Once triggered, SCR2 will stay on as long as current flows through it. Since the current that is diverted through SCR2 is derived directly from the AC line power, SCR2 will remain on—and thus relay K1 will remain deactivated—until the AC line power is removed from the circuit 110 (e.g., the appliance is unplugged from the AC power outlet). A safety latching mechanism is thus provided.

A further switching device, SCR3, provides a trigger signal for turning on SCR2 and thus deactivating the relay K1. A capacitor C3 is coupled between the cathode and gate of SCR2 to prevent noise spikes from triggering SCR2. Resistors R4 and R5 serve to adjust the sensitivity of the triggering of SCR2. A network comprising a resistor R16, a diode D3 and a capacitor C4, arranged as shown, causes SCR2 to fire a predetermined time interval after SCR3 turns off. In the exemplary embodiment shown, the predetermined time interval is preferably approximately 2–6 ms so sensing can still occur in a half cycle of the 60 Hz AC line voltage (or 8 ms). The noise filtering and delay network thus provided prevents false triggering of SCR2 by removing high frequency noise and adding a delay to the trigger signal. This filtering provides substantial immunity against noise. Furthermore, the primary power control device, relay K1, is not sensitive to AC line surges or spikes.

Voltage sensing at the end of the PTC wire element 175 is accomplished with a voltage sensing sub-circuit 177, as mentioned above. In the exemplary embodiment of FIG. 2, the voltage sensing sub-circuit 177 comprises a resistor voltage divider R14, R15 and a transistor Q1. If the voltage across the end of the PTC wire element 175 is greater than a minimum set point voltage, the switch Q1 will be turned on. This generates the BLANKET OK signal which is provided to the control circuit. When Q1 is on, SCR3 is turned on through resistors R13 and R9, which in turn, keeps SCR2 from firing. Until SCR2 is triggered, the relay K1 stays energized. If the voltage at the end of the blanket is lost either from a short or an open circuit, switch Q1, will turn off. This, in turn, drops out the trigger switch SCR3 and allows SCR2 to fire, deactivating the relay K1 and turning off power to the heating element 175 in the blanket.

The control circuit 110 mixes the BLANKET OK signal with a sample of the power applied to the blanket and is level shifted to provide a signal to the trigger switch SCR3. Mixing in a sample of the power applied to the PTC element prevents tripping when the temperature controller cycles power to the PTC wire. More specifically, when the temperature controller 150 cycles off power to the heating element 175, there will be no voltage at the end of the heating element. To prevent this from triggering SCR2 and thus deactivating the relay K1, a resistor R8 will hold SCR3 on, thereby preventing the deactivation of the relay K1. When the temperature controller 150 re-cycles power to the heating element 175, the resistor R8 is shorted out and the transistor Q1 is once again allowed to control the firing of SCR3 in accordance with the voltage sensed at the end of the heating element 175.

The voltage sensing sub-circuit 177 is preferably located in the blanket 170. With such an arrangement, only three conductors are required to couple the blanket 170 to the control circuit 110, namely: two wires for applying power to the blanket (including a common or ground) and a wire for the voltage sense signal (BLANKET OK). Preferably, improperly connecting the blanket 170 to the control circuit 110 will cause a tripping of the circuit, thereby preventing the application of power to the improperly connected blanket.

The voltage sensing sub-circuit 177 advantageously operates with low current, thereby reducing the portion of power dissipated in the control circuitry and improving the overall efficiency of the heating appliance.

In a preferred embodiment, in order to reapply power to the heating blanket 170, the fault condition must be corrected (e.g., by repairing or replacing the heating blanket) and power must be removed and reapplied to the control circuit 110. If the fault condition is still present when power is reapplied to the circuit 110, the circuit will not reset and thus will not reapply power to the blanket 170.

A further advantageous feature of the exemplary embodiment shown is that the common failure mode of the components used will cause a trip condition. As such if the circuit 110 fails due to component failure, power will be removed from the blanket 170. The circuit 110 preferably must be operating normally in order to apply power to the blanket 170.

Figure 3:
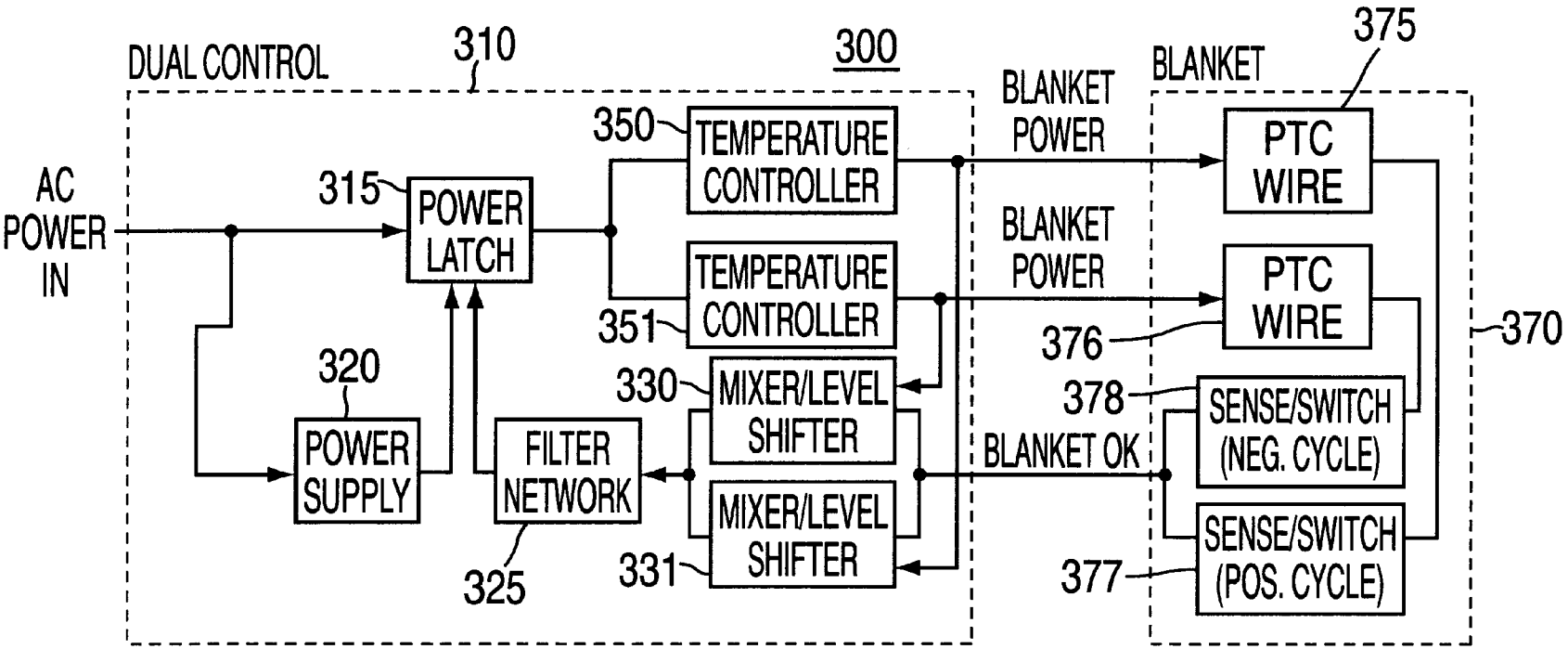
FIG. 3 is a block diagram of a second exemplary embodiment of a circuit in accordance with the present invention.

FIG. 3 shows a block diagram of an exemplary embodiment of a dual-element heating appliance 300, in accordance with the present invention. The exemplary appliance 300 comprises a control circuit 310 and a heating blanket module 370 having a first PTC wire heating element 375 and a second PTC wire heating element 376. The heating blanket module 370 comprises a first voltage sensing sub-circuit 377, for sensing the voltage at the end of the first PTC heating element 375, and a second voltage sensing sub-circuit 378, for sensing the voltage at the end of the second PTC heating element 376. The voltage sensing sub-circuits 377, 378 generate a combined BLANKET OK signal, as described more fully below, which indicates the condition of the heating elements 375, 376.

The control circuit 310 is similar in function to the single-element control circuit 110 of FIG. 1. The circuit 310 includes two temperature controllers 350, 351, one for each heating element 375, 376. The circuit 310 also includes two mixer/level shifters 330, 331, one for each heating element, a power latch 315, a power supply 320 and a filter network 325.

Figure 4:
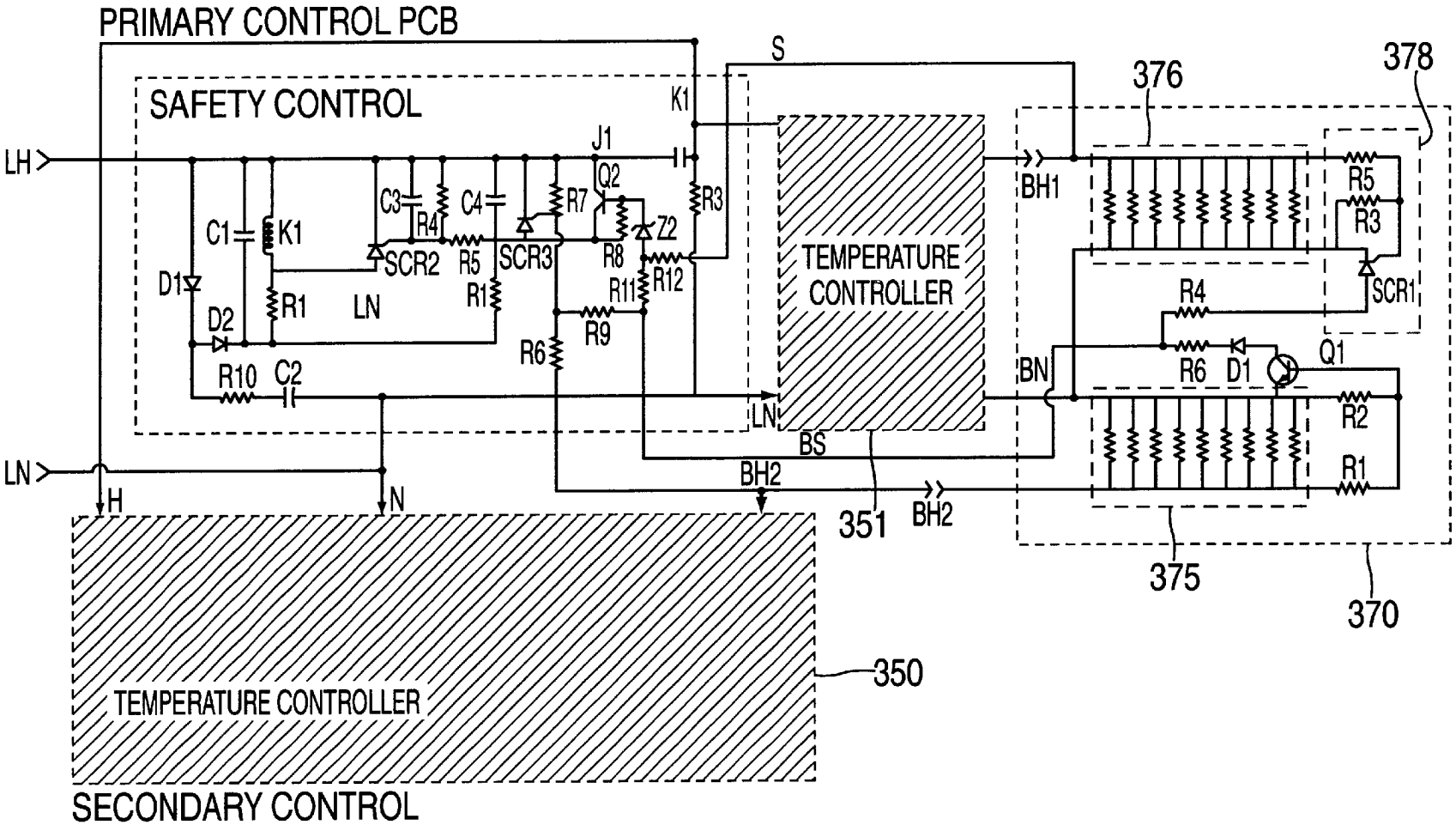
FIG. 4 is a schematic diagram of the exemplary circuit of FIG. 3.

FIG. 4 shows a schematic diagram of an exemplary dual heating element appliance, such as that of FIG. 3. The voltage sensing sub-circuit 377 for sensing the voltage at the end of the PTC wire element 375 comprises a resistor voltage divider (R1, R2) and a transistor Q1. The voltage sensing sub-circuit 378 for sensing the voltage at the end of the PTC wire element 376 comprises a resistor voltage divider (R3, R5) and an SCR SCR1. The voltage sensing sub-circuit 378 is active during the positive half cycle of the AC power whereas the voltage sensing sub-circuit 377 is active during the negative half cycle. As such, depending on which half cycle the AC power is in, SCR1 or Q1 can provide a trigger signal to fire SCR2. Both signals can thus share a common line (BLANKET OK) from the blanket module 370.

As with the embodiment of FIGS. 1 and 2, if the voltage sensed at the end of the heating element 375 is greater than a threshold value, the transistor Q1 will be on, thereby holding off the trigger signal for SCR2 and allowing the relay K1 to provide power to the heating elements. Similarly, if the voltage sensed at the end of the heating element 376 is greater than a threshold value, SCRl will be on, thereby holding off the trigger signal for SCR2 and allowing the relay K1 to provide power to the heating elements. Q1 will only conduct during the positive half cycle, receiving its gating signal from SCR1. SCR3 will only conduct during the negative half cycle, receiving its drive signal from Q1.

The signals generated by the sub-circuits 377, 378 are separated in the control circuit 310 and mixed with samples from the PTC input power. The mixed signals are then level shifted by a transistor Q2 (for the first heating element) and an SCR SCR3 (for the second heating element). Mixing of a sample of the input power to the PTC wire heating elements prevents tripping when each of the temperature controllers 350, 351 cycles power to the respective PTC wire heating element 375, 376. The two signals from the level shifters are combined to produce the trigger signal for SCR2 which causes SCR2 to short the relay coil. The combined signal passes through the filter network to prevent false tripping. If the BLANKET OK signal is active for both half cycles, SCR2 stays off and the power control relay, K1, stays energized. A fault condition in either PTC wire will cause the BLANKET OK signal to go inactive for that phase, thereby activating SCR2, dropping out K1 and removing power to the entire blanket module 370.

Resistors R12 and R6 are included to prevent false triggering of SCR2 when the temperature controllers 350, 351 cycle off power to the heating elements.

Any failures in the system, from the blanket-heating element through the voltage sensing sub-circuits, to the switch devices, to the triggering device and finally the relay would cause power to the blanket to be shut down.

As with the single-element embodiment described above, the dual-element embodiment has a low wire count between the heating device (i.e., the blanket 370) and the control circuit 310. Namely, there is one common wire, two power wires (one for each heating element) and a wire for the voltage sense signal (BLANKET OK).

What is claimed is:

1. A heating appliance comprising:

a heating element; and a control circuit, the control circuit being coupled to the heating element for monitoring a condition of the heating element and selectively applying power to the heating element in accordance with the monitored condition, wherein the control circuit includes:

a voltage detector, the voltage detector detecting a voltage of the heating element, the voltage in relation to a threshold voltage being indicative of a normal or faulty condition of the heating element;

a first switching device, the first switching device providing power to the heating element when the first switching device is in a first state and removing power from the heating element when the first switching device is in a second state; and a second switching device, the second switching device being coupled to the voltage detector and the first switching device and controlling the first switching device to be in the first state when the detected voltage indicates that the heating element is in the normal condition and controlling the first switching device to be in the second state when the detected voltage indicates that the heating element is in the faulty condition.

2. The appliance of claim 1 comprising a temperature controller, the temperature controller being arranged between the heating element and the control circuit.

3. The appliance of claim 1, wherein the heating element comprises a positive thermal coefficient (PTC) element.

4. The appliance of claim 1 comprising a further heating element and a further voltage detector, the further voltage detector detecting a further voltage of the further heating element, wherein the voltage detector and the further voltage detector are coupled to the second switching device to control the first switching device in accordance with a condition of at least one of the heating element and the further heating element.

5. A heating appliance comprising:

a heating element;

a temperature controller; and a control circuit, the control circuit being coupled to the heating element for monitoring a condition of the heating element and selectively applying power to the heating element in accordance with the monitored condition, wherein the control circuit includes:

a voltage detector, the voltage detector detecting a voltage of the heating element, the voltage being indicative of a normal or faulty condition of the heating element;

a first switching device, the first switching device providing power to the heating element when the first switching device is in a first state and removing power from the heating element when the first switching device is in a second state;

a second switching device, the second switching device being coupled to the voltage detector and the first switching device and controlling the first switching device to be in the first state when the detected voltage indicates that the heating element is in the normal condition and controlling the first switching device to be in the second state when the detected voltage indicates that the heating element is in the faulty condition; and a mixing device, the mixing device mixing a power applied to the heating element with the detected voltage of the heating element, the mixing device being coupled between the voltage detector and the second switching device;

wherein the temperature controller is arranged between the heating element and the control circuit.

* * * * *